US005458285A

United States Patent [19]

Remien

[11] Patent Number: 5,458,285

[45] Date of Patent: Oct. 17, 1995

[54] COIN SECURITY SYSTEM

[75] Inventor: Jerome Remien, Northbrook, Ill.

[73] Assignee: Jerome Remien Corporation, Elk Grove Village, Ill.

[21] Appl. No.: 250,014

[22] Filed: May 27, 1994

[51] Int. Cl.[6] ..... G07B 15/00

[52] U.S. Cl. ..... 232/15; 194/350; 232/16

[58] Field of Search ..... 232/15, 16, 43.1; 109/24.1; 194/350

[56] References Cited

U.S. PATENT DOCUMENTS

| | | | |
|---|---|---|---|
| 1,411,898 | 4/1922 | Augenbraun . | |
| 1,983,089 | 12/1934 | Knee | 232/15 |
| 2,009,085 | 7/1935 | Jackson | 232/15 |
| 2,783,937 | 3/1957 | Hudson | 232/15 |
| 3,033,442 | 5/1962 | Erlichman | 232/15 |
| 3,653,586 | 4/1972 | Bonneson | 232/43.2 |
| 3,677,461 | 7/1972 | Nitschneider et al. | 232/15 |
| 3,807,627 | 4/1974 | Nitschneider | 232/15 |
| 3,807,628 | 4/1974 | Bock | 232/16 |
| 3,837,566 | 9/1974 | McGough | 232/15 |
| 3,974,961 | 8/1976 | Domkowiski | 232/16 |
| 4,267,962 | 5/1981 | Domkowiski | 232/15 |
| 4,291,831 | 9/1981 | Domkowski | 232/15 |
| 4,380,316 | 4/1983 | Glinka et al. | 232/16 |
| 4,729,509 | 3/1988 | Diekhoff | 232/16 |
| 4,877,179 | 10/1989 | Baker et al. | 232/15 |
| 5,224,579 | 7/1993 | Brown | 194/350 |
| 5,259,491 | 11/1993 | Ward, II | 232/16 |

FOREIGN PATENT DOCUMENTS

| | | |
|---|---|---|
| 958617 | 12/1974 | Canada . |
| 1386579 | 3/1975 | United Kingdom . |

*Primary Examiner*—Michael J. Milano

*Attorney, Agent, or Firm*—Maxwell J. Petersen; Willian Brinks Hofer Gilson & Lione

[57] ABSTRACT

A coin security system is provided which electronically monitors coins passing into a portable coin collection security bag in order to discourage pilferage of coins stored in the collection bag. A memory chip associated with the bag, or with a mounting member connected to the bag, is in communication with the central data processor in the vending machine circuit when the collection bag is mounted and is receiving coins. When the portable collection bag is disconnected, the memory chip becomes disconnected from the circuit and breaks the circuit, causing the vending machine to shut down. This automatic shutdown feature reduces another kind of pilferage by discouraging the depositing of coins into the vending machine when the coin collection security bag is not in place.

20 Claims, 5 Drawing Sheets

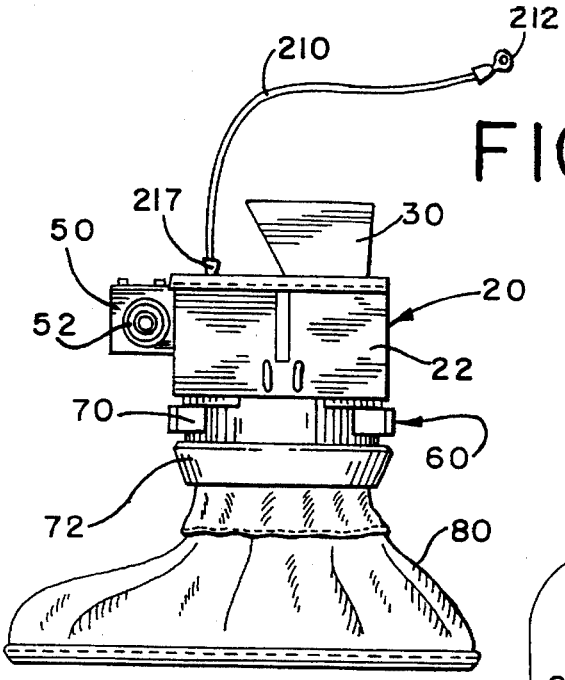
FIG. 1
FIG. 2
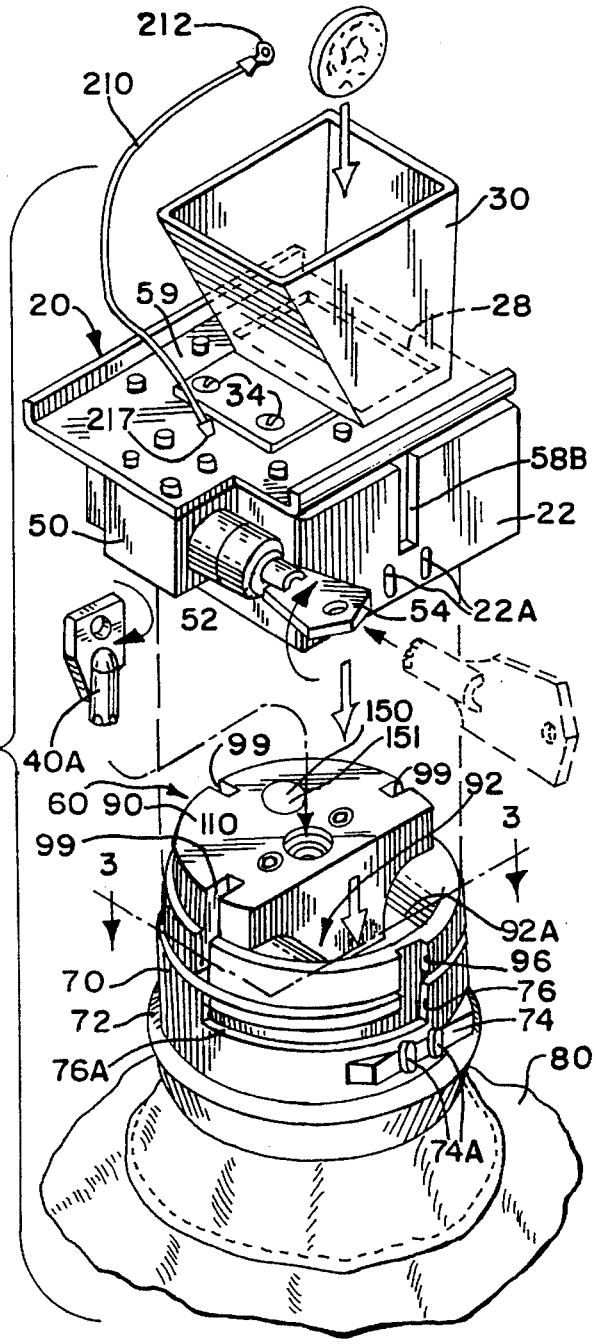
FIG. 3
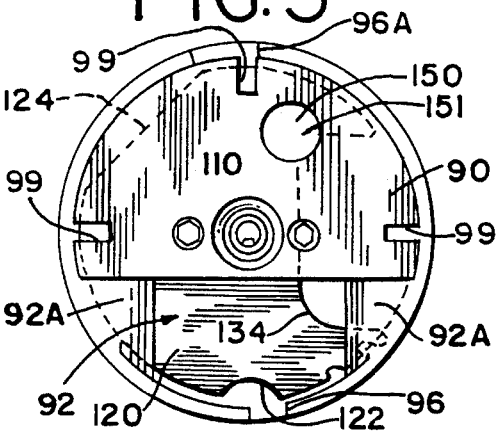
FIG. 3a
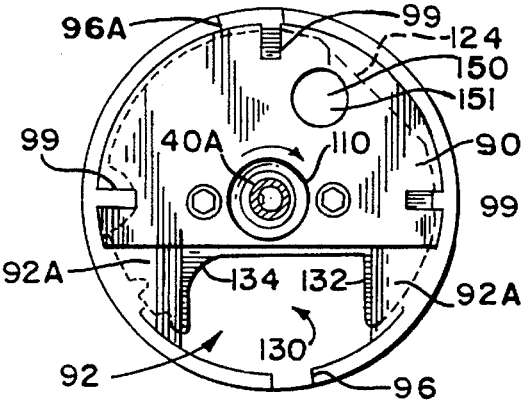

FIG. 12
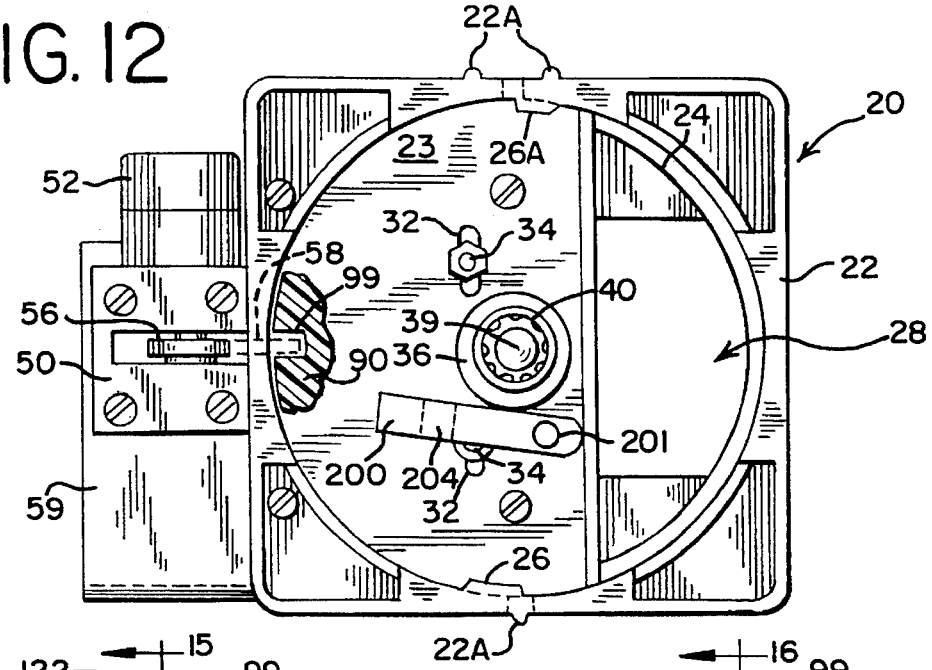
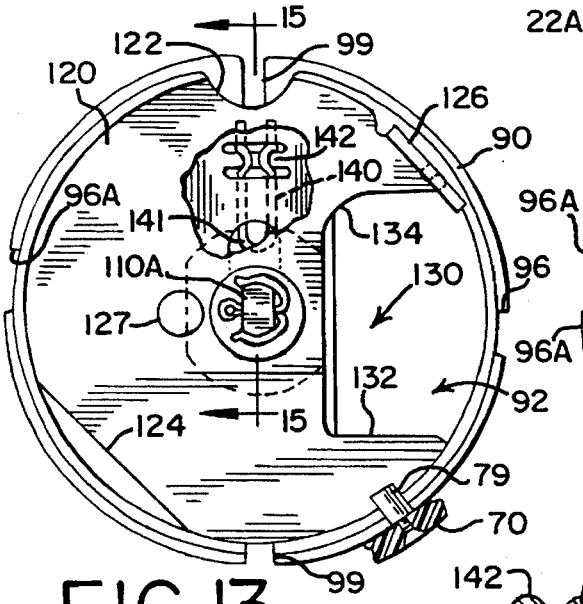
FIG. 13
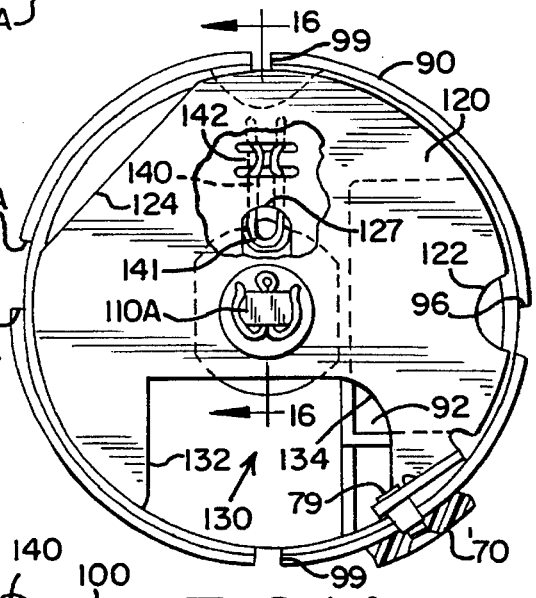
FIG. 14
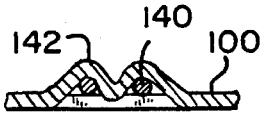
FIG. 15a
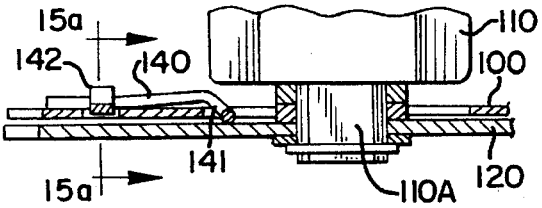
FIG. 15
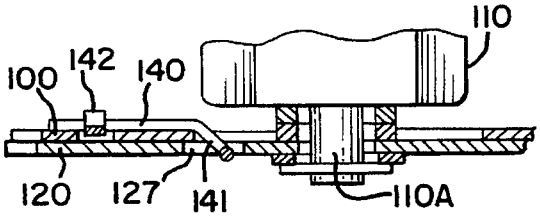
FIG. 16

COIN SECURITY SYSTEM

FIELD OF THE INVENTION

This invention relates to an improved security system for collecting and storing coins, and more particularly to an improved security system for collecting and storing coins in a coin-operated vending machine.

BACKGROUND OF THE INVENTION

U.S. Pat. No. 4,267,962, issued to Domkowski, discloses a coin security system for use in vending machines, which includes an upper coin inlet portion (housing) a lower (portable) coin storage portion, and a mounting assembly (also portable) engaging the storage portion. Coins are deposited into a vending machine and a selection of merchandise is made. The coins pass through a series of stations in the machine which totalize and register a credit for the merchandise. The coins then pass into the coin security system, through the upper coin inlet housing and into the lower coin storage portion.

The upper inlet housing is adapted for securing in place in a vending machine, and includes a first locking mechanism engaged by a first key, for locking the lower coin storage portion into a receiving position on the upper inlet housing. When the first key is turned to remove the portable storage portion, there is a corresponding movement of an internal closure mechanism which operates to close off the storage container. This closure mechanism involves cooperation between elements of the upper inlet housing and the mounting assembly engaged to the portable storage portion. Thereafter, between the time the storage portion is removed from the vending machine and the time it reaches headquarters for emptying, it is not possible to insert or remove coins from the storage portion. The coins contained in the storage portion are thereby protected from pilferage during transportation.

Once the storage portion reaches headquarters, a second key is engaged to a second locking mechanism in the mounting assembly in order to release the contents of the storage portion. Thereafter, the storage portion can be emptied, returned to the vending machine and replaced.

The foregoing security system has been quite effective in protecting coins from pilferage after they have been deposited into the storage container and while the storage container is being transported from the vending machine to headquarters. However, there are still three potential kinds of pilferage which may cause problems from time to time. First, a cunning route man may remove a full coin storage container from the housing without immediately replacing it with an empty one, allowing some coins to fall through the housing and to the floor of the inside of the vending machine. Second, a route man may succeed in "jimmying" the lock of a removed coin storage container, or in obtaining an extra key. Third, some pilferage may occur at headquarters, after an authorized person has unlocked the portable coin storage container. These kinds of pilferage are difficult to detect, and may go unnoticed.

SUMMARY OF THE INVENTION

The present invention offers at least a partial solution to the three kinds of pilferage mentioned above. In addition to the security system described above, the invention involves the use of a computer memory chip, a coin detector, an electrical interface, a data processor, and a relay.

Most of today's vending machines already come equipped with a circuit which includes an on/off power switch, a coin receiver with a light to indicate when the machine is "on", an electronic coin sensor/detector, a computerized data processor interfacing with the coin sensor/detector, and a merchandise dispensing mechanism in communication with, and receiving commands from, the data processor. The coin security system of the invention is particularly useful with these modern vending machines. The upper housing of the conventional coin security system is modified to include an electrical connector which leads from the vending machine circuit, described above, to an interface between the upper housing and the portable lower storage portion. The portable portion of the conventional coin security system is modified to include a computer memory chip (for example, in the mounting assembly) which interfaces with the vending machine circuit only when the portable storage portion is locked into place on the upper housing, and which breaks the circuit when the portable storage portion is unlocked and removed.

In effect, the improved coin security system becomes part of the vending machine circuit. During normal operation of the vending machine, the computerized data processor transmits information regarding the number and type of coins received by the vending machine and detected by the coin sensor. This information is transmitted to the memory chip in the portable portion of the coin security system, via the interface circuitry.

When the portable portion is removed, the vending machine circuit is broken, causing the machine to shut off until the portable portion is replaced. At this time, the vending machine light is off, the machine will not dispense merchandise, and consumers are unlikely to deposit coins which would fall to the floor of the vending machine for pilferage by a cunning route man.

When the portable portion reaches headquarters, the memory chip is interfaced with another data processor which reads the information from the chip and erases the chip for the next cycle of use. The information read from the memory chip accurately reflects the type and number of coins deposited into the vending machine and detected by the coin sensor, and should agree with the amount of money in the coin storage portion. This makes it much more difficult for someone to pilfer coins from the storage portion, without being caught.

With the foregoing in mind, it is a feature and advantage of the invention to provide an improved coin security system which acquires and maintains an intelligent record of coins deposited into the vending machines and stored in the coin security system, until the coins are emptied and counted at a location remote from the vending machine.

It is also a feature and advantage of the invention to provide an improved coin security system which shuts down the vending machine automatically when the coin storage portion of the security system is removed from the vending machine, and until the coin storage portion is replaced.

It is also a feature and advantage of the invention to provide an improved vending machine which incorporates the improved coin security system of the invention.

The foregoing and other features and advantages of the invention will become further apparent from the following detailed description of the presently preferred embodiments, read in conjunction with the accompanying drawings. The detailed description and drawings are merely illustrative rather than limiting, the scope of the invention being defined by the appended claims and equivalents thereof.

BRIEF DESCRIPTION OF THE DRAWINGS

FIG. 1 is a side elevational view of the coin security system of the invention for use in vending machines or the like, showing the electrical connector for joining the security system with the vending machine circuit.

FIG. 2 is an exploded perspective view of the coin security system showing the interrelationship between the upper housing, which is usually joined to a vending machine, and the locking and mounting components on the portable lower coin storage portion.

FIG. 3 is a plan view of parts of the coin storage portion, taken along line 3—3 in FIG. 2, showing the coin storage portion locked in a closed position and showing the memory chip.

FIG. 3A corresponds to FIG. 3 except the coin storage portion is in an open position.

FIG. 12 is a bottom plan view of the upper housing, taken along line 12—12 in FIG. 9 and showing the interface bracket for interfacing the electrical connector with the memory chip when the portable coin storage portion is in a locked and open position mounted to the upper housing.

FIG. 13 is a bottom plan view of the locking cap shown in FIGS. 2 and 3, with the locking plate in a closed position.

FIG. 14 corresponds to FIG. 13 except that the locking plate is in an opened position.

FIG. 15 is a partial cross-sectional view of the locking cap, taken along line 15—15 in FIG. 13, showing a spring for assisting movement of the locking plate into a closed position.

FIG. 15A is a sectional view taken along line 15A—15A in FIG. 15, showing how the locking plate spring is mounted.

FIG. 16 is a partial sectional view of the locking cap, taken along line 16—16 in FIG. 14, showing the spring in position to positively lock the locking plate in the closed position.

DETAILED DESCRIPTION OF THE PRESENTLY PREFERRED EMBODIMENTS

As is known from U.S. Pat. No. 4,267,962, and as shown generally in FIGS. 1–4, the coin security system of the invention includes an upper housing assembly adapted to be secured within a vending machine, and designed to receive the various coins which are inserted into the machine during the vending operation. A second major component of the coin security system is a portable coin collection device, such as the coin bag 80. The coin bag 80 is made form a heavy canvas material or the like, and is adapted to collect and store coins which are inserted into the vending machine and transmitted through the housing assembly 20. A third major component of the coin security system is a coin bag locking and mounting assembly 60. This bag locking and mounting assembly 60 (also portable) is joined to the upper mouth portion of the coin bag 80, and functions to selectively connect the coin bag 80 to the upper housing assembly 20 in the vending machine.

Figure 9:
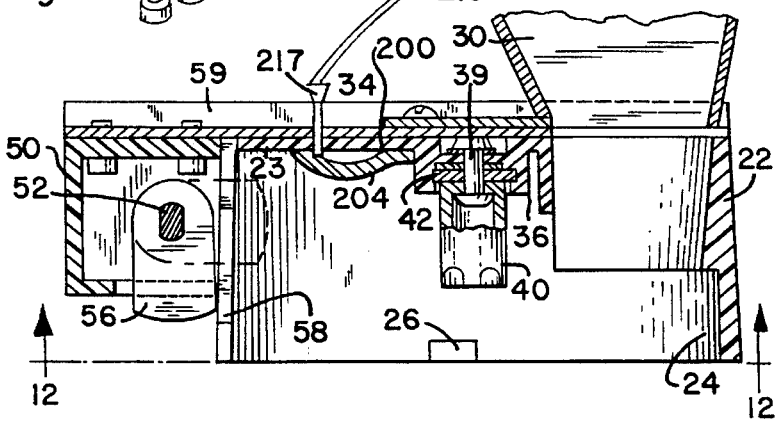
FIG. 9 is a sectional view of the upper housing taken along line 9—9 in FIG. 8, showing the electrical connector and also showing an interface bracket for communicating between the electrical connector of the housing and the memory chip embedded in the mounting assembly on the portable coin storage portion.

In accordance with the invention, a computer memory chip 150 is embedded in the coin bag mounting assembly 60, with an upper surface 151 exposed, as explained further below. Above the upper housing assembly 20, an electrical connector wire 210 leads from the main vending machine circuit (FIG. 17) and is connected to the vending machine circuit interface at a first terminal end 212. The electrical connector wire passes through the upper housing assembly 20 as shown in FIG. 9, and terminates at a second (main) terminal bracket 200 visible in FIGS. 9 and 12. The terminal bracket 200 has a bulge 204 which, as explained further below, engages the exposed surface 151 of the memory chip 150 when the bag assembly 60 is in a mounted and locked position relative to the upper housing assembly 20.

The upper housing assembly 20 and the mounting assembly 60 cooperate to lock the coin bag 80 in place on the housing assembly 20, in an opened position, for receiving coins during operation of the vending machine. Also, these components function to automatically lock the coin bag 80 in a closed position when the coin bag 80 is removed from the housing assembly 20 for transportation of the coin bag to headquarters. FIG. 1 illustrates these above-described major components 20, 60 and 80 in their assembled position, as they would appear within a vending machine during the vending phase operation. FIG. 2 generally illustrates the relationship of the components as the coin bag 80 is removed from the housing assembly 20 in a locked position.

Figure 8:
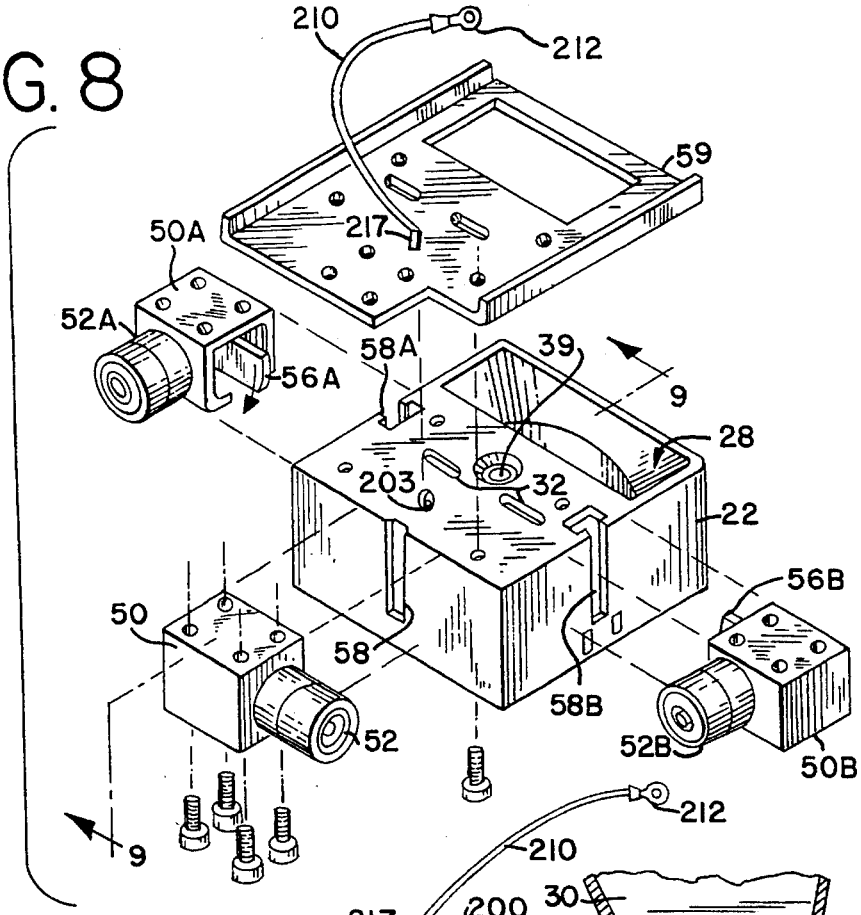
FIG. 8 is an exploded perspective view of the upper housing, showing the electrical connector for joining the security device to the vending machine circuit and showing a manner of adapting the security system to different lock positions in different vending machines.

The upper machine housing assembly 20 is more fully illustrated in FIGS. 2, 8 and 12 of the drawings. Referring to those figures, the housing assembly 20 includes a central, generally rectangular housing member 22. To minimize weight and expense, the housing member 22 is preferably cast from a lightweight, impact-resistant plastic material. The lower portion of member 22 is provided with a circular opening 24 of preselected dimensions, for receiving the coin bag mounting and locking assembly 60, as described further below. Diametrically opposed positioning and retaining tabs 26 and 26A are cast into the member 22, for cooperation with mating grooves and slots in the coin bag mounting and locking assembly 60.

As seen clearly in FIGS. 2 and 8, one side of the upper portion of the member 22 is provided with a coin-receiving opening 28. The opening 28 extends across the member 22, and has a width sufficient to receive the largest anticipated coin, e.g., the U.S. ½ dollar coin, without jamming. A funnel 30 is mounted on the member 22 above the opening 28, to direct the coins from the vending machine through the coin-receiving opening 28. A pair of lateral slots 32 provided in the member 22 receive fasteners 34 to join the funnel 30 to the housing. The slots 32 permit adjustment of the funnel 30 to the varying dimensions of different vending machines.

Figure 10:
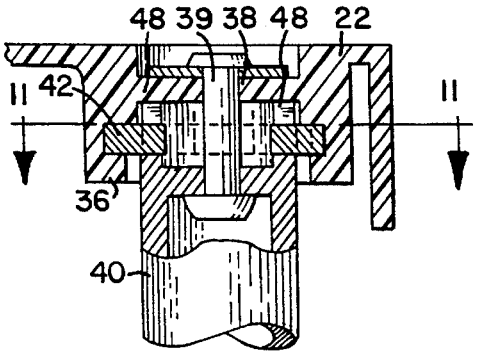
FIG. 10 is an enlarged partial sectional view of the key stem portion of the upper housing shown in FIG. 9.

As shown in FIGS. 9, 10 and 12, the central portion of the housing member 22 includes a downwardly extending boss 36. A central opening 38 in the boss 36 receives a rivet 39 for securing within the boss a key stem 40. As explained further below, the key stem 40 functions as a key, and is inserted in a mating locking member provided on the coin bag locking and mounting assembly 60, for activating the mechanisms which open and close the bag 80 during the vending and coin transporting operations.

Due to the security requirements of the system, this key stem 40 must be firmly retained against rotation within the housing member 22 during the insertion and removal of the coin bag 80. Otherwise, the bag 80 could be removed from the member 22 in an opened position, and the coins in the bag could be removed. Security requirements also dictate that this key stem 40 be secured firmly in the boss 36, to prevent pilferage by tampering with the machine to override the security locking functions of the system.

Figure 11:
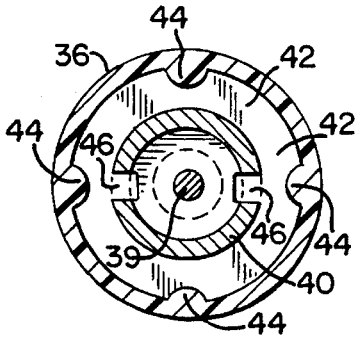
FIG. 11 is a sectional view taken along the line 11—11 in FIG. 10, of the mechanism for fixing the key stem in the housing to improve the resistance of the security system to tampering.

Accordingly, the key stem 40 is firmly implanted in the boss 36 against rotation by means of a high-strength retaining washer 42. As shown in FIG. 11, the retaining washer 42 includes peripheral recesses 44 at the quadrants of the washer, and a pair of diametrically opposed abutment tabs 46. The washer 42 is cast in-place in the boss 36 as the housing member 22 is formed. By this arrangement, the material forming the housing 36 firmly engages the washer 42 within the peripheral recesses 44, as seen in FIG. 11. This method of construction firmly imbeds the washer 42 in the boss 36, and causes the recesses 44 to function as detents which prevent rotation of the washer. As shown in FIGS. 10 and 11, the washer abutment tabs 46 are dimensioned for engagement with the key stem 40 within correspondingly dimensioned and diametrically opposed grooves 48. To decrease the possibility of tampering and pilferage, the key stem 40 and the retaining washer 42 are made from a high-strength material, such as heat-treated steel. By this arrangement, any attempts to rotate the key stem 40 in the boss 36 are prevented by the shear strength of the abutment tabs 46.

As set forth above, the housing assembly 20 is designed to be mounted in place in the vending machine during the operation of the system of this invention. The design of such vending machines is not standardized, so that different machines require different locations for the assembly 20 and different operating key placements. Accordingly, to adjust the housing assembly 20 to different vending machine designs, the housing 20 is readily adaptable for mounting within a vending machine in a plurality of different positions.

As illustrated in FIGS. 2, 8 and 12, this versatility of the housing assembly 20 is made possible by the inclusion in the system of a separate, integrally-designed lock box 50. This lock box 50 carries a tumbler-type key lock 52 of suitable construction which is preferably operated by cylindrical key 54. The lock 52 is either a counter-clockwise or clockwise lock, depending on the orientation of the lock box 50. The lock 52 illustrated in FIG. 2 is a clockwise lock, and is activated into a locked position by rotating the key 54 90° in a counter-clockwise direction.

The lock 52 includes a locking tab 56 which is moved between a locked and an unlocked position by the rotation of the key 54. In the lock box 50 illustrated in FIGS. 2 and 8, the lock 52 is arranged so that the tab 56 is in a downward unlocked position, as shown in solid lines in FIG. 9, when the key 54 is inserted therein. A rotation of the key 54 counter-clockwise through a 90° arc moves the tab 56 into its inward locked position, as shown in dotted lines in FIG. 9. A mating slot 58 is provided in the adjacent side wall of the housing member 22, as shown in FIGS. 8 and 9. The slot 58 receives the locking tab 56, and permits the tab 56 to extend into the housing 22 in a locking position when the key lock 52 is rotated into its locked position, as described above. A mounting plate 59 is secured to the upper surface of the housing member 22, and is adapted to mount the key box 50 on the housing member 22 in the desired location adjacent the slot 58.

The illustrated mounting plate 59 and the slot 58 will also receive a key box 50 and lock 52 in a second orientation. This second orientation is accomplished by reversing the key box 50, so that the lock 52 extends from the opposite side of the box 50 (downwardly from the box 50 in FIG. 12). The tab 56 can be rotated into a locking position within the related slot 58 by reversing the operation of the lock 52. With such a modification, a 90° rotation of the lock 52 in a clockwise direction moves the tab 56 into the slot 58.

As shown in FIG. 8, the housing assembly 20 is designed for two additional mounting positions for the key box 50. A second side wall of the housing 22 is provided with a locking slot 58A for receiving the locking tab 56A, of a lock box 50A having a key lock 52A. The mounting plate 59 would be replaced by a different plate which would extend over the key box 50A. As described above with respect to the box 50, the key box 50A can be used for two different key locations, by reversing the position and rotational characteristics of the key lock 52A. Likewise, a third wall of the housing member 22 is provided with a locking slot 58C. A third modified mounting plate 59 is used to mount a lock box 50B adjacent the locking slot 58B. The related key lock 52B is operable to rotate the tab 56B of the lock into a locking position with the slot 58B, in a manner similar to that described above. The key box 50B also can be used in two locations by reversing the position and rotational characteristics of the key lock 52B. In this manner, the housing assembly 20 is adapted to receive three key boxes 50, 50A or 50B, each of which can be used in two locations. This design greatly improves the versatility of the system by permitting the assembly 20 to be readily adapted to a plurality of vending machine designs.

As shown in FIGS. 2, 8, 9 and 12, in accordance with the invention, the electrical connector wire 210 originating from the first terminal 212 joins the housing 20 at a sleeve 217 and passes through an opening 203 extending through the mounting plate 59 and the housing member 22. The connector wire 212 terminates at the second (main) terminal bracket 200 and is connected thereto. The terminal bracket 20 includes a bulge 204, and is fastened to a lower surface 23 of the housing member 22 using a rivet 201. The terminal bracket 200 is adjacent the downwardly extending boss 36 of the housing member 22, as shown in FIG. 9.

Figure 4:
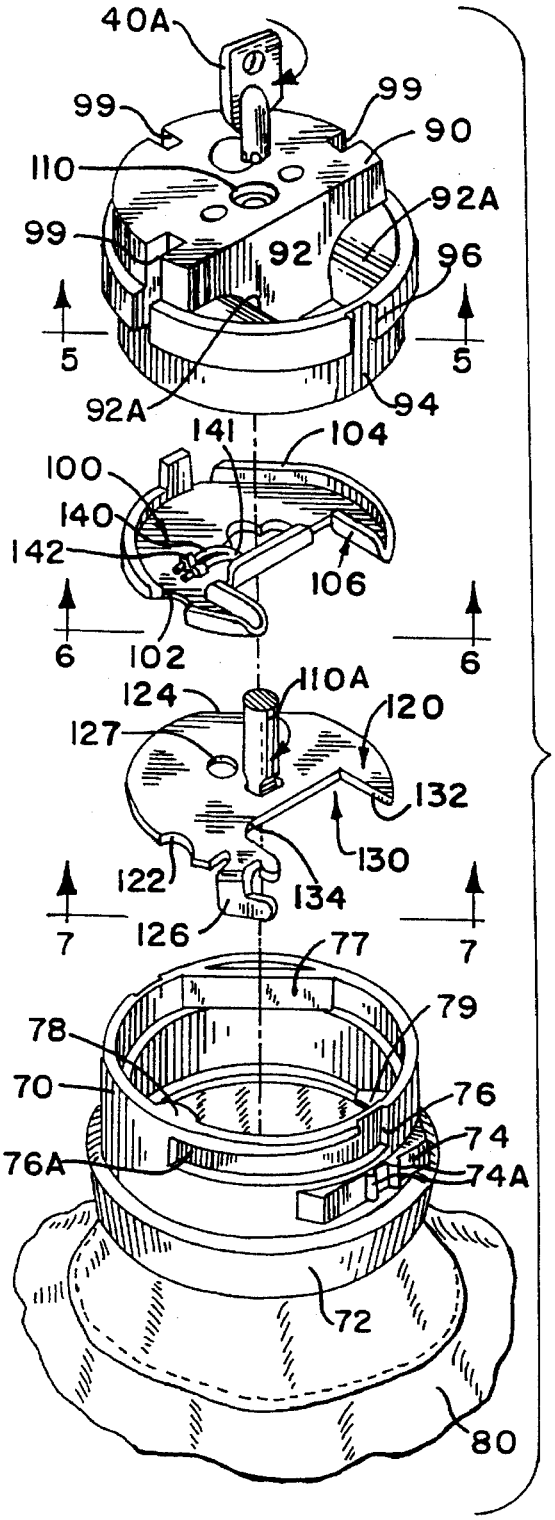
FIG. 4 is an exploded perspective view of the locking and mounting components on the coin storage portion which cooperate to allow it to be selectively locked in an open or closed position.

As indicated in FIGS. 2 and 4, other major components of the security system of this invention are the collection and storage bag 80 and the associated locking and mounting assembly 60. The assembly 60 includes a bag mounting ring 70 as shown in FIGS. 2 and 4. This ring 70 is preferably cast from a durable lightweight plastic material, such as the same material from which the housing assembly 20 is cast. The ring 70 is permanently secured to the mouth of the bag 80 by a retaining ring 72. The ring 72 is made from a high strength material, such as steel or the like, and slidably engages within a circular groove provided on the bag ring 70. Thus, the ring 70 is firmly attached to the bag 80, but can rotate with respect to the bag. The outer surface of the ring 72 includes diametrically spaced ledges 74 which assist in the proper alignment of the ring 70 and the bag 80 with the housing assembly 20 during the mounting of the bag within the vending machine. The ledges 74 are provided with indicia tabs 74, which correspond to similar tabs 22A on the housing 22 (see FIG. 2) to further facilitate the proper initial alignment of the bag ring 70 and the housing 22. The bag ring 70 also includes a pair of diametrically opposed thread-type grooves 76 having a horizontal portion 76A. During the mounting operation, the grooves 76 are aligned with the tabs 26, 26A (see FIGS. 9 and 12) on the housing member 22. Relative rotation of the bag ring 70 will slide the tabs 26, 26A within the grooves 76, 76A, and secure the bag ring 70 and the associated bag 80 onto the housing member 22. The opposed tabs 26, 26A and the mating grooves 76A are preferably of slightly different dimensions, so that proper orientation of the bag ring 70 with respect to the housing 20 is assured.

The interior surface of the bag ring 70 includes means which assist in the alignment of the various components, and in the locking of the bag 80 selectively in an opened or closed position during the vending and collection operations. In this regard, the interior surface of the ring 70 includes an abutment sector 77; a shoulder 78; and a projecting retaining pin 79. These parts 77, 78 and 79 are located approximately 120° apart, to provide a stable three-point connection to the locking plate 120 of the locking cap 90, as explained further below. The configuration of the parts 77, 78 and 79 also cooperate to properly align the locking cap 90 and the bag ring 70.

Figure 5:
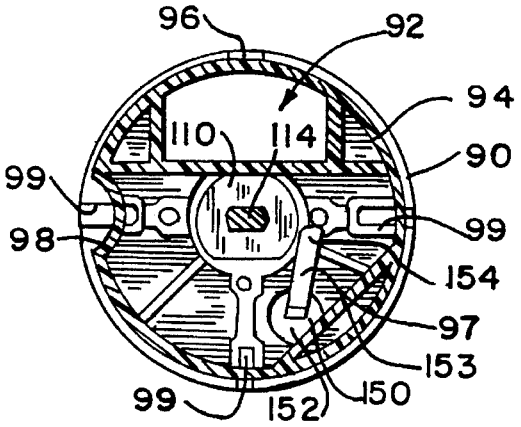
FIG. 5 is a sectional view taken along line 5—5 in FIG. 4, showing the bottom of the locking cap including the bottom of the memory chip and a grounding bracket.

As also seen in FIGS. 2 and 4, the assembly 60 further includes a locking cap 90. The cap 90 is preferably made from the same lightweight, durable material as used to form the bag ring 70 and the housing member 22. The cap 90 is dimensioned to fit within the wide mouth of the bag ring 70, to selectively close the bag 80 during the use of the system of the present invention. As seen in FIGS. 4 and 5, a large sector of the cylindrical cap 90 defines a coin-receiving opening 92. This opening 92 is aligned with the opening 28 in the machine housing 22, to receive coins from the machine and direct the coins into the bag 80. The direction of the coin flow is indicated by the arrows in FIG. 2. The side walls 92A of the opening 92 are preferably contoured as shown in FIGS. 2 and 4, to assure a smooth entry of all sizes of coins into the bag 80. As discussed above, the opening 92 is dimensioned so that it will freely receive the largest potential coin, such as the U.S. ½ dollar coin.

A distending circular flange portion 94 on the lower part of the cap 90 is dimensioned to extend within the bag ring 70. This flange portion 94 includes a straight recess 97 and a circular recess 98, as seen in FIGS. 4 and 5. These recesses 97 and 98 align, respectively, with the shoulders or abutments 77 and 78 provided on the interior surface of the bag ring 70, as seen in FIG. 4. The recesses 97 and 98 thus align the cap 90 and the ring 70 properly, and prevent the cap 90 from rotating with respect to the ring 70. Diametrically opposed vertical grooves 96 are also provided on the upper portion of the cap 90. As seen in FIG. 2, these grooves 96 align with the corresponding grooves 76 in the bag ring 70. The grooves 96 and 97 are, hence, adapted to receive the tabs 26, 26A on the housing 22 as the bag 80 and the mounting and locking assembly 60 are inserted upwardly within the housing assembly 20.

Figure 18:
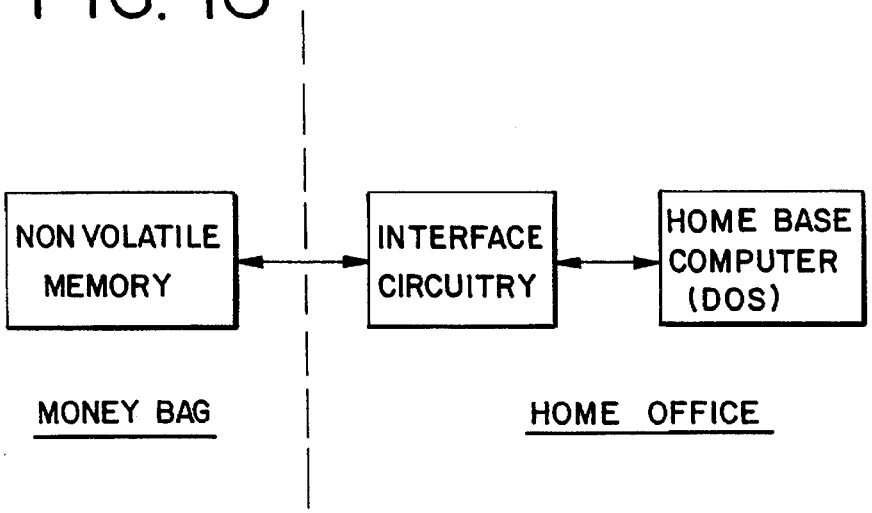
FIG. 18 is a schematic drawing of an external circuit used to read, analyze, and erase the memory chip at headquarters.

As shown in FIGS. 3, 3*a*, 4 and 5, a circular memory chip 150 having an upper (positive) exposed surface 151 and a lower (negative) surface 152 is embedded or mounted in the cap 90. The memory chip 150 is strategically positioned relative to the main terminal bracket 200 on the housing member 22 such that, when the coin security system is assembled and locked into position, the bulge 204 of the terminal bracket 200 is directly underneath, and engages, the upper surface 151 of the computer memory chip 150, to thereby integrate the memory chip 150 into the main vending machine circuit (FIG. 18). The lower surface 152 of the memory chip 150 is also at least partially exposed on the lower surface of the cap 90, and engages a lower bracket 153 mounted to the cap 90 using a rivet 154. The lower bracket 153 extends between the memory chip 150 and the cylindrical lock 110, and also engages the lock 110, in order to ground any current flowing through the memory chip 150 when the coin security system is assembled and locked into position.

The chip 150 may be any compatible memory chip having a suitable storage capacity. One suitable commercially available chip is a Touch Memory chip. The Touch Memory chip is stimulated by a 5-volt signal and responds by switching the input resistance four orders of magnitude, from 500,000 to 50 ohms. The Touch Memory chip is available with storage capacities of one kilobyte, four kilobytes or higher, depending on the complexity and amount of information being received from the vending machine circuit.

Figure 17:
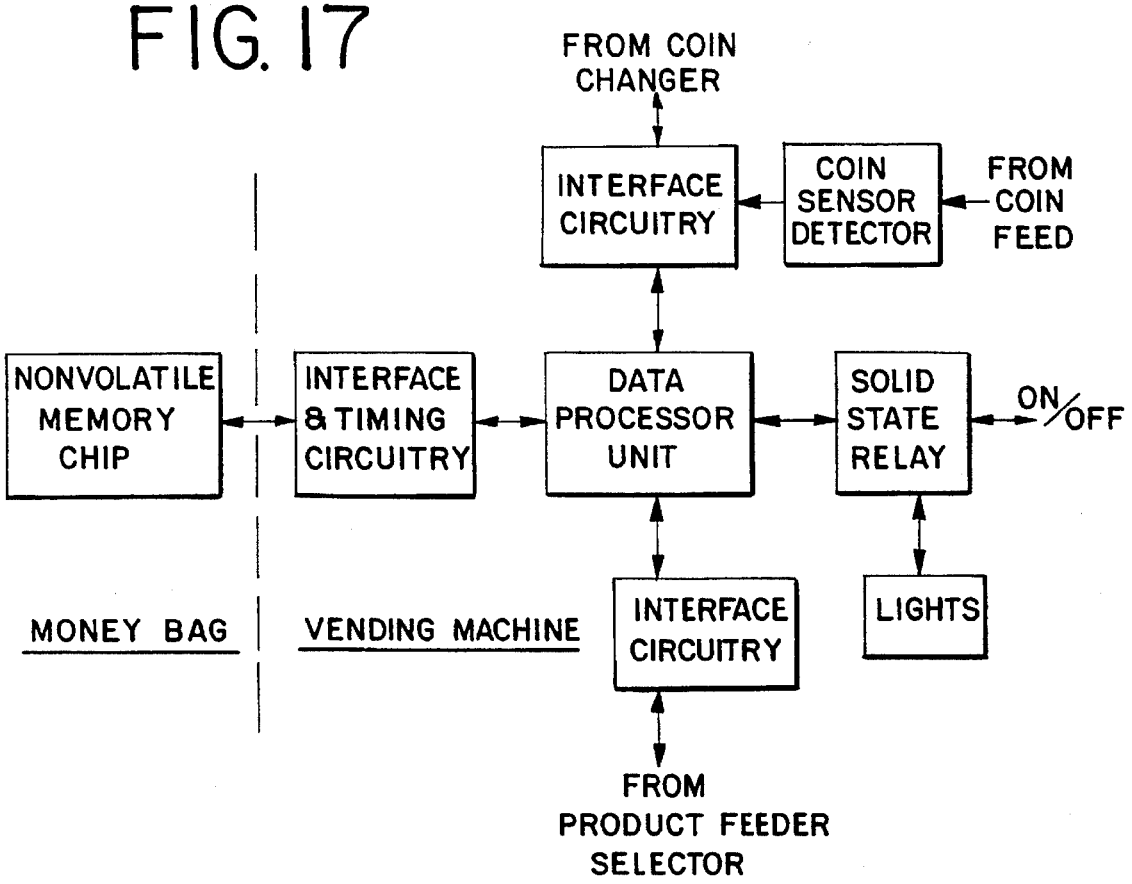
FIG. 17 is a schematic diagram of an inside circuit for a vending machine using the coin security system of the invention.

FIG. 17 illustrates schematically how the memory chip 150 mounted in the locking cap 90 of the coin bag mounting assembly 60, interfaces with the vending machine circuitry. A conventional vending machine circuit includes a data processing unit which interfaces with a coin sensor/detector, a product feed mechanism, a coin changer, and a relay for turning the vending machine on and off.

The coin sensor/detector detects, counts, and distinguishes between coins of different sizes as they enter the vending machine. The coin sensor/detector sends signals to the data processor unit indicating the amount of coins on credit, or the amount of credit available, for a purchase. The data processor unit also receives signals from a product feeder/selector when a selection of merchandise is made. If the available credit is sufficient to cover the purchase, the data processor sends a signal to the feeder/selector permitting the merchandise to be dispensed and, if appropriate, sends a signal to the coin changer commanding the dispensing of change.

The conventional data processing unit also communicates with a solid state relay and switch for turning the vending machine on and off. When the switch is on, the solid state relay activates the data processor unit and also activates the vending machine lights. When the switch is off, both the data processor unit and lights (as well as the remainder of the vending machine circuit) are deactivated.

In accordance with the invention, and as shown in FIG. 17, the memory chip 150 also interfaces with the vending machine data processor unit when the coin bag mounting assembly 60 is in the assembled and locked position relative to the housing 20. When in this position, information received from the coin sensor/detector regarding coins that have been fed into the vending machine, is transmitted and stored in the memory chip 150. In this fashion, the memory chip 150 keeps an accurate count of the amount of money entering and stored in the coin bag 80.

When the coin bag mounting assembly 60 is unlocked from the housing 20, the electrical circuit is broken between the memory chip 150 and the data processor unit. This causes the entire vending machine circuitry (including lights, coin sensor/detector, data processor unit, and product feeder/selector) to shut down. When the vending machine is obviously off, a consumer is unlikely to deposit coins or attempt to purchase merchandise.

After the coin bag mounting assembly 60 and coin bag 80 have been removed from the housing 20 and transported to headquarters, the memory chip 150 can be interfaced with a home base computer as shown schematically in FIG. 18. This permits a cross-checking at headquarters between the amount of money stored in the coin bag 80 and the information stored in the memory chip 150, thereby discouraging any pilfering of coins from the bag either while the bag is being transported or when the money is being counted at headquarters.

Further mechanical embodiments of the coin security system will now be described. As further seen in FIGS. 4–6, the cap 90 also includes three locking grooves 99, which are spaced 90° apart on the quadrants of the cap 90. As explained further below, these locking grooves 99 become aligned with the slots 58 provided in the housing member 22, and are thereby positioned to receive the tab 56 of the lock 52. When the system in accordance with this invention is assembled and locked in position, the lock 52 and the tab 56 will prevent the rotation of the cap 90 within the housing 22 due to the engagement between the cap grooves 99 and the tab 56.

As seen in FIG. 5, the casting of the cap 90 from the preferred material normally creates a series of webs and compartments in the underside of the cap 90. It has been found that if these webs and compartments remain exposed, it is possible for a coin to become entrapped or jammed within the underside of the cap 90. When this event occurs, the entrapped coin will interfere with the locking operation of the system. Accordingly, the cap 90 is provided with a closure plate 100, as seen in FIG. 4, to prevent such interference with the functions of the system.

Figure 6:
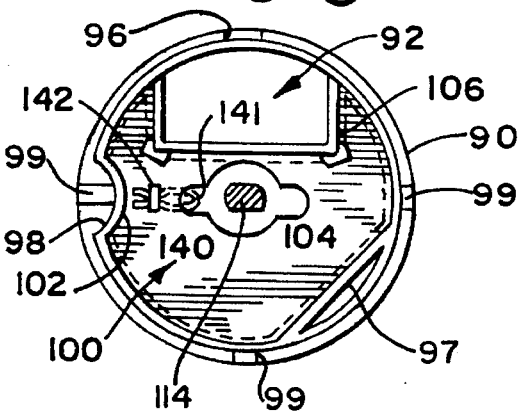
FIG. 6 is a sectional view of the locking cap taken along line 6—6 in FIG. 5, showing the use of a closure plate to minimize jamming of the coins in the locking cap.

FIG. 6 illustrates the placement of the closure plate 100 on the underside of the cast cap 90. As seen in FIG. 6, the closure plate 100 includes recesses 102 and 104 which align with the recesses 98 and 97, respectively, provided on the cap 90. An opening 106 is also provided in the closure plate 100, for alignment with the coin-receiving opening 92 of the cap 90. Thus, the closure plate 100 can be placed on the underside of the cap 90 to prevent the jamming of coins into the cap, without interfering with the functions of the cap 90.

The center of the cap 90 includes a cylindrical lock 110. This lock 110 receives the key stem 40 of the housing assembly 20 when the cap 90 is inserted within the housing member 22. The lock 110 also can be actuated by a separate key 40A (FIG. 4) which corresponds to the key stem 40. This separate key 40A is usually retained at the home office of the vending company so that the bag 80 cannot be opened outside of the home office. A key shaft 110A extends downwardly from the lock 110, as seen in FIG. 4, and is secured to a rotatable locking plate 120. The connection between the shaft 110A and the plate 120 is a positive connection, so that the plate 120 rotates in unison with the key shaft 110A upon activation of the lock 110.

Figure 7:
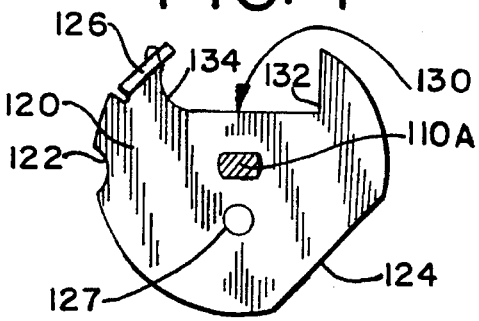
FIG. 7 is a bottom view of the rotatable locking plate, taken along line 7—7 in FIG. 4.

As shown in FIGS. 4 and 7, the plate 120 is provided with recesses 122 and 124 which coincide with the recesses 98 and 97 on the cap 90. As clearly seen in FIG. 4, the plate 120 also includes a distending locking leg 126. This leg 126 is designed to engage with and lock against the pin 79 when the cap 90 is placed within the bag ring 70 and the plate 120 rotated a selected distance (preferably 90°) into a locked position by the operation of the lock 110. The locking leg 126 cooperates with the pin 79 to operate as a detent against further rotation of the plate 120, and to lock the plate 120 and the cap 90 onto the bag ring 70.

The locking plate 120 includes a coin-receiving aperture 130. This aperture 130 is specially constructed so that in an open position, in alignment with the opening 92 provided in the cap 90, the aperture 130 freely receives the largest expected coin in any configuration or orientation (see FIG. 13). For example, the width of the aperture 130 could be selected to receive a U.S. dollar coin which has a diameter of approximately one inch. Furthermore, the plate 120 is designed so that, when rotated 90° with respect to the cap 90, it will effectively close the coin-receiving aperture 92 of the cap 90 (see FIG. 14). In this closed position, the plate 120 must block the passage from the bag 80 of a coin of the smallest expected dimensions, such as U.S. dime having a diameter of approximately 0.70 inches.

Thus, the configuration of the coin-receiving aperture 130 must accept a coin of maximum size in one position (open; FIG. 13) and block the passage of a coin of minimum size in another position (locked closed; FIG. 14). To accomplish these functions, the aperture 130 has a width, and includes a leading edge 132 which has a length, greater than the size of the largest coin, e.g., greater than one inch. The trailing edge 134 of the aperture 130 (the edge which trails into the opening 92 of the cap 90 as the locking plate 120 is rotated) has a length corresponding to the length of the edge 132. Thus, the width of the aperture 130 throughout its length (to the edge connecting the edges 132 and 134) is equal and the aperture is substantially rectangular. However, the trailing edge 134 is provided with a substantial radius of curvature which reduces the effective length of the edge 134. The radius of curvature of edge 134 also reduces the effective area of the trailing half of the aperture 130 below the area of the leading half. This arrangement of the plate 120 and the coin-receiving aperture 130 permits the plate 120 to be moved between an open position, such as shown in FIGS. 3A and 13, and a locked position, as shown in FIGS. 3 and 14. In the opened position, the area of plate aperture 130 is generally coincident with the area of the cap opening 92, and the coin-receiving aperture 130 will freely receive the largest coin in any orientation. In the closed position, as seen in FIGS. 3A and 14, the radius of curvature provided on the trailing edge 134 is selected to sufficiently reduce the width and area of the trailing half of the aperture 130 so that the plate 120 blocks the aperture 130 for the smallest coin. For example, if a U.S. dime is the smallest coin, the radius for the edge 134 is selected so that, as seen in FIG. 14, the opening between the plate 120 and the cap 90 in the cap opening 92, has a maximum dimension less than about 0.70 inches. Of course, different parameters would be needed for handling coinage of different sizes.

As seen in FIGS. 13–16, the cap 90 also includes a locking spring 140, to assist in positively locking the plate 120 in the locked position. The locking spring 140 is a U-shaped spring wire unit which is secured to the closure. Spring 140 extends downwardly through an opening in the plate 100, towards the locking plate 120. The spring 140 thus biases the locking plate 120 away from the closing plate 100 and thereby minimizes sliding friction between the two adjacent plates. As seen in FIGS. 15 and 16, the locking plate 120 is provided with an aperture 127 for receiving the projecting end 141 of the spring 140, as the plate 120 approaches the final, locked position. The curvature of the spring end 141 cooperates with the aperture 127 to urge the plate 120 into its final locked position. The spring 140 thus overcomes any frictional drag between the adjacent plates 100 and 120, and assures that the plate 120 will be positively locked by the lock 110. The spring 140 thereby minimizes the possibility of frictional drag preventing the complete enlargement of the tumblers in the lock 110. Under such circumstances, the locking of the plate 120 would be incomplete and the security of the system compromised.

The operation of the system in accordance with this invention usually commences with the bag 80 and the locking and mounting assembly 60 in a locked position. As shown in FIGS. 2 and 3, in this locked position the aperture 92 in the cap 90 is closed by the plate 120, so that even the smallest coin cannot be removed from the bag 80. In this locked position, the cap 90 is oriented with respect to the bag ring 70, so that the grooves 96 and 76 are in alignment, as shown clearly in FIG. 2. A route man carries the bag in this condition to a vending machine, for placement within the housing assembly 20 in the vending machine.

To install the bag 80 in the machine, the route man orients the cap 90 and the bag 80 beneath the housing assembly 20, so that the grooves 96 and 76 are in alignment with the tabs 26, 26A within the housing 22 (see FIG. 2). The cap 90 and bag 80 are then directed upwardly into the recess 24 (FIG. 9) defined by the housing 22. The tabs 26, 26A slide within the grooves 96 and 76, and the key stem 40 is inserted within the key lock 110 in the cap 90. When the insertion is complete, the route man then rotates the bag ring 70 and the associated cap 90 (counter-clockwise in FIG. 2) through a 90° arc. This rotation causes the tabs 26, 26A to engage within the horizontal portion 76A of the grooves. The tabs 26, 26A and grooves 76A thus retain the bag 80 and cap 90 within the housing 22. Also, the rotation causes the bulge 204 of the terminal bracket 200 on the housing assembly 20 to engage the positive upper surface 151 of the computer memory chip 150 in the cap 90, thereby completing the vending machine circuit so that the vending machine can be activated.

Thus, rotation of the bag 80 and cap 90 through a 90° arc also causes the key stem 40 to activate the lock 110 and rotates the locking plate 120 a corresponding distance into an opened position, such as shown in FIGS. 3A and 13. In this position, the bag 70 and cap 90 are affixed within the housing member 22, and the system is prepared to receive, collect and store the coins fed into the vending machine. To lock the bag 80 in place, the route man used a key 54, as illustrated in FIG. 2. This key 54 is inserted into the lock 52 and turned through a 90° arc, as described above, to activate the lock 52. The locking tab 56 is thereby projected through the slot 58 in the housing member 22 and into the groove 99 provided on the cap 90. The key 54 then can be removed. The engagement between the cap grooves 99 and the locking tab 56 prevents the rotation of the cap 90 in the machine. Likewise, since the cap 90 mates the abutments 77, and 78 on the bag ring 70, the bag ring 70 is precluded from rotation. Accordingly, the bag 80 is locked in place, and cannot be removed from the vending machine 20.

In the next phase of operation, the route man returns to the vending machine to collect the coins when the bag 80 is filled. To accomplish this, the route man key 54 is inserted in lock 52 and rotated 90° in the opposite direction (clockwise in FIG. 2). This removes the locking tab 56 from the slot 99 in the cap 90. The bag ring 70 and the associated cap 90 then can be rotated by the route man through a 90° arc. This rotation again aligns the housing tabs 26, 26A with the grooves 96 and 76 (FIG. 2) so that the bag 80 can be removed from the housing mechanism 22. This rotation also causes the key stem 40 to activate the key lock 110, to rotate the lock 110, and the associated plate 120 into a closed position, as shown in FIGS. 3 and 14. In this position, the locking tab 126 engages the pin 79, and the plate 120 closes the cap closure 92. The cap 90 is thus secured to the bag ring 70 in a locked and closed position before the bag 80 can be removed from the vending machine housing 20. The same rotation also causes the positive upper surface 151 of the memory chip 150 to become disengaged from the terminal bracket 200, breaking the vending machine circuit and causing the vending machine to shut down.

The route man then removes the bag 70 from the housing 20, in a locked condition, and delivers it to the home office or headquarters. At the home office a key 40A, comparable to the key insert 40, is inserted within the lock 110, and the plate 120 is rotated into the opened position, as shown in FIGS. 3A and 13. The cap 90 can then be removed from the bag ring 70, and the coins can be discharged. Also, the contents of the computer memory chip 150 can be analyzed as described above with respect to FIG. 18, and this information can be compared with the coins removed from the bag 80.

When the accounting department is finished with the bag 80, the cap is again placed on the bag, the lock 110 is activated to close the locking plate 110 across the aperture 92, and the process described above can be repeated by installing the bag 80 in a vending machine.

While the embodiments of the invention disclosed herein are presently considered to be preferred, various modifications and improvements can be made without departing from the spirit and scope of the invention. The scope of the invention is indicated in the appended claims, and all changes that fall within the meaning and range of equivalents are intended to be embraced therein.

I claim:

1. A coin security system for storing and keeping track of coins deposited into a vending machine, comprising:

an upper housing assembly adapted for securing within a vending machine, including an inlet for receiving coins of various sizes inserted into the vending machine;

a portable coin collection assembly for collecting and storing coins transmitted through the upper housing assembly; and a locking and mounting assembly removably attached to the portable coin collection assembly for selectively mounting and dismounting the portable coin collection assembly to and from the upper housing assembly, and for locking the portable coin collection assembly in an open receiving position when mounted to the housing assembly, and in a closed position when dismounted from the housing assembly;

the upper housing assembly further including an electrical connector originating within a vending machine circuit, and a terminal bracket at a terminal end of the electrical connector;

the locking and mounting assembly further including a memory chip communicating with the terminal bracket when the portable coin collection assembly is mounted and locked on the housing assembly and disengaged from the terminal bracket when the portable coin collection assembly is dismounted;

wherein the housing assembly is adapted for connection to the vending machine and for releasable connection to the locking and mounting assembly and the portable coin collection assembly.

2. The coin security system of claim 1, wherein the locking and mounting assembly further comprises:

a coin receiving aperture for directing coins into the portable coin collection assembly;

a rotatable closure plate movable between an opened position allowing coins to pass through the aperture and a closed position blocking the passage of coins through the aperture;

a first actuating mechanism for selectively driving the closure plate between the opened and closed positions; and abutment mechanisms arranged in a plurality of selected positions.

3. The coin security system of claim 2, wherein the housing assembly further comprises:

a mechanism for receiving coins processed by the vending machine and for directing the coins into the portable coin collection assembly;

a plurality of locking stations arranged in selected positions about the housing assembly, each locking station being alignable with at least one abutment mechanism;

a second actuating mechanism engageable with the first actuating mechanism to drive the closure plate into the opened position as the locking and mounting assembly is rotated with respect to the housing assembly to align one of the abutment mechanisms with one of the locking stations; and an integral locking mechanism adapted to be positioned at one of the locking stations and including a locking detent movable between a locked and an unlocked position, the integral locking mechanism and detent being arranged to permit relative rotation of the locking and mounting assembly and the housing assembly in an unlocked position and further arranged to engage the locking detent with the abutment mechanism to prevent relative rotation of the locking and mounting assembly and the housing assembly when the detent is in an unlocked position.

4. The coin security system of claim 1, wherein the memory chip comprises a positive surface and a negative surface, the negative surface communicating with a ground, the positive surface communicating with the terminal bracket when the portable coin collection assembly is mounted and locked on the housing assembly and disengaged from the terminal bracket when the portable coin collection assembly is dismounted.

5. The coin security system of claim 1, wherein the memory chip has a storage capacity of at least about one kilobyte.

6. The coin security system of claim 1, wherein the memory chip receives signals from within the vending machine circuit when engaged to the main terminal bracket, and breaks the vending machine circuit when disengaged from the main terminal bracket.

7. A coin security system for use with a vending machine circuit including a data processor unit in communication with an on/off switch, a coin sensor/detector, and a product feeder/selector, comprising:

a stationary housing including an inlet for receiving coins of various sizes;

a portable coin collection device for collecting and storing coins which pass through the housing;

a locking and mounting assembly removably attached to the portable coin collection device for selectively mounting and dismounting the portable coin collection device to and from the housing, and for locking the coin collection device in a closed position by blocking the passage of coins to and from the coin collection device when the coin collection device is dismounted, and in a coin receiving position permitting the passage of coins when the coin collection device is mounted;

a computer memory chip in communication with the data processor unit only when the portable coin collection device is mounted to the housing in the coin receiving position, and isolated from the data processor unit when the portable coin collection device is dismounted; and an electronic interface mechanism communicating between the data processor unit and the computer memory chip only when the portable coin collection device is mounted to the housing in the coin receiving position;

whereby the computer memory chip receives and stores information from the data processor regarding the coins entering the portable coin collection device;

wherein the computer memory chip forms part of the vending machine circuit when the coin collection device is mounted to the housing, such that the circuit is broken when the coin collection device is dismounted.

8. The coin security system of claim 7, wherein the computer memory chip is housed in the locking and mounting assembly.

9. The coin security system of claim 7, wherein the computer memory chip communicates with the data processor unit via an electrical connector wire passing through the housing.

10. A coin security system for use with a coin collecting container and a coin processing machine, comprising:

a mounting and locking member removably attached to the container and including a coin-receiving opening for directing coins into the container;

a rotatable locking plate mounted on the member and movable between an opened position and a closed position, the plate including an aperture alignable with the opening, with the plate in the opened position, to allow coins to pass through the aligned opening and aperture into the container, the plate in the closed position operating to block the passage of coins through the opening;

a locking mechanism to releasably secure the plate in the closed position;

a closure plate mounted on the lower side of the member and having an aperture coincident with the coin-receiving opening in the member, so that the closure plate allows the passage of coins through the opening while preventing jamming of coins between the member and the rotatable locking plate; and a computer memory chip mounted to the member for collecting and storing information regarding the coins passing into the container when the rotatable locking plate is in the opened position; and a mechanism for electronically activating the computer memory chip to receive information when the rotatable locking plate is in the opened position, and for electronically isolating the computer memory chip when the rotatable locking plate is in the closed position.

11. The coin security system of claim 10, wherein the computer memory chip has a storage capacity of at least about one kilobyte.

12. The coin security system of claim 10, further including a spring mounted to the closure plate and arranged to bias the closure and locking plate apart and to engage and drive the locking plate toward the closed position.

13. A coin security system for use with a coin-collecting container and a coin-processing machine, comprising:

a mounting and locking member removably attached to the container and including a coin-receiving opening for directing coins of varying size into the container, the minimum dimension of the opening being selected to exceed the maximum dimension of the coins;

a rotatable locking plate mounted on the member and movable between an opened position and a closed position, the plate including an aperture rotatable into alignment with the opening with the plate in the opened position and configured to substantially coincide with the opening, to thereby allow the passage of coins of a selected maximum dimension through the opening and plate aperture in the opened position;

a computer memory chip mounted to the member for collecting and storing information regarding coins passing into the container when the rotatable locking plate is in the opened position; and a mechanism for electronically activating the computer memory chip to receive information when the rotatable locking plate is in the opened position, and for electronically isolating the computer memory chip when the rotatable locking plate is in the closed position.

14. The coin security system of claim 13, wherein the plate is configured so that the area of the trailing half of the aperture, as the plate is rotated into the closed position, is a selected amount less than the area of the leading half of the aperture, and the plate thereby blocks the passage of a coin of a selected minimum dimension through the opening in the member.

15. The security system of claim 13, wherein the opening in the member is substantially rectangular and has a selected area, and the plate aperture is substantially coincidentally rectangular and has at least a leading edge, a trailing edge, and a connecting side, the trailing edge and connecting side defining a selected radius of curvature which selectively reduces the area of the trailing half of the aperture.

16. A coin security system for storing and keeping track of coins deposited into a vending machine, comprising:

an upper housing assembly adapted for securing within a vending machine, including an inlet for receiving coins of various sizes inserted into the vending machine;

a portable coin collection assembly for collecting and storing coins transmitted through the upper housing assembly; and a locking and mounting assembly removably attached to the portable coin collection assembly for selectively mounting and dismounting the portable coin collection assembly to and from the upper housing assembly, and for locking the portable coin collection assembly in an open receiving position when mounted to the housing assembly, and in a closed position when dismounted from the housing assembly;

the upper housing assembly further including an electrical connector originating within a vending machine circuit, and a terminal bracket at a terminal end of the electrical connector;

the locking and mounting assembly further including a memory chip communicating with the terminal bracket when the portable coin collection assembly is mounted and locked on the housing assembly and disengaged from the terminal bracket when the portable coin collection assembly is dismounted;

wherein the memory chip comprises a positive surface and a negative surface, the negative surface communicating with a ground, the positive surface communicating with the terminal bracket when the portable coin collection assembly is mounted and locked on the housing assembly and disengaged from the terminal bracket when the portable coin collection assembly is dismounted.

17. A coin security system for storing and keeping track of coins deposited into a vending machine, comprising:

an upper housing assembly adapted for securing within a vending machine, including an inlet for receiving coins of various sizes inserted into the vending machine;

a portable coin collection assembly for collecting and storing coins transmitted through the upper housing assembly; and a locking and mounting assembly removably attached to the portable coin collection assembly for selectively mounting and dismounting the portable coin collection assembly to and from the upper housing assembly, and for locking the portable coin collection assembly in an open receiving position when mounted to the housing assembly, and in a closed position when dismounted from the housing assembly;

the upper housing assembly further including an electrical connector originating within a vending machine circuit, and a terminal bracket at a terminal end of the electrical connector;

the locking and mounting assembly further including a memory chip communicating with the terminal bracket when the portable coin collection assembly is mounted and locked on the housing assembly and disengaged from the terminal bracket when the portable coin collection assembly is dismounted;

wherein the memory chip has a storage capacity of at least about one kilobyte.

18. A coin security system for storing and keeping track of coins deposited into a vending machine, comprising:

an upper housing assembly adapted for securing within a vending machine, including an inlet for receiving coins of various sizes inserted into the vending machine;

a portable coin collection assembly for collecting and storing coins transmitted through the upper housing assembly; and a locking and mounting assembly removably attached to the portable coin collection assembly for selectively mounting and dismounting the portable coin collection assembly to and from the upper housing assembly, and for locking the portable coin collection assembly in an open receiving position when mounted to the housing assembly, and in a closed position when dismounted from the housing assembly;

the upper housing assembly further including an electrical connector originating within a vending machine circuit, and a terminal bracket at a terminal end of the electrical connector;

the locking and mounting assembly further including a memory chip communicating with the terminal bracket when the portable coin collection assembly is mounted and locked on the housing assembly and disengaged from the terminal bracket when the portable coin collection assembly is dismounted;

wherein the memory chip receives signals from within the vending machine circuit when engaged to the main terminal bracket, and breaks the vending machine circuit when disengaged from the main terminal bracket.

19. A coin security system for use with a vending machine circuit including a data processor unit in communication with an on/off switch, a coin sensor/detector, and a product feeder/selector, comprising:

a stationary housing including an inlet for receiving coins of various sizes;

a portable coin collection device for collecting and storing coins which pass through the housing;

a locking and mounting assembly removably attached to the portable coin collection device for selectively mounting and dismounting the portable coin collection device to and from the housing, and for locking the coin collection device in a closed position by blocking the passage of coins to and from the coin collection device when the coin collection device is dismounted, and in a coin receiving position permitting the passage of coins when the coin collection device is mounted;

a computer memory chip in communication with the data processor unit only when the portable coin collection device is mounted to the housing in the coin receiving position, and isolated from the data processor unit when the portable coin collection device is dismounted; and an electronic interface mechanism communicating between the data processor unit and the computer memory chip only when the portable coin collection device is mounted to the housing in the coin receiving position;

whereby the computer memory chip receives and stores information from the data processor regarding the coins entering the portable coin collection device;

wherein the computer memory chip is housed in the locking and mounting assembly.

20. A coin security system for use with a vending machine circuit including a data processor unit in communication with an on/off switch, a coin sensor/detector, and a product feeder/selector, comprising:

a stationary housing including an inlet for receiving coins of various sizes;

a portable coin collection device for collecting and storing coins which pass through the housing;

a locking and mounting assembly removably attached to the portable coin collection device for selectively mounting and dismounting the portable coin collection device to and from the housing, and for locking the coin collection device in a closed position by blocking the passage of coins to and from the coin collection device when the coin collection device is dismounted, and in a coin receiving position permitting the passage of coins when the coin collection device is mounted;

a computer memory chip in communication with the data processor unit only when the portable coin collection device is mounted to the housing in the coin receiving position, and isolated from the data processor unit when the portable coin collection device is dismounted; and an electronic interface mechanism communicating between the data processor unit and the computer memory chip only when the portable coin collection device is mounted to the housing in the coin receiving position;

whereby the computer memory chip receives and stores information from the data processor regarding the coins entering the portable coin collection device;

wherein the computer memory chip communicates with the data processor unit via an electrical connector wire passing through the housing.

* * * * *